US007931473B2

(12) United States Patent
Watkins et al.

(10) Patent No.: US 7,931,473 B2
(45) Date of Patent: Apr. 26, 2011

(54) MULTI-VOLTAGE PUMP WITH DISCREET VOLTAGE CORDS

(75) Inventors: William J. Watkins, Tipp City, OH (US); Mark Kowalak, Troy, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 86 days.

(21) Appl. No.: 12/396,892

(22) Filed: Mar. 3, 2009

(65) Prior Publication Data

US 2010/0099286 A1 Apr. 22, 2010

Related U.S. Application Data

(60) Provisional application No. 61/106,350, filed on Oct. 17, 2008.

(51) Int. Cl.
*H01R 29/00* (2006.01)

(52) U.S. Cl. ..... 439/49; 439/956

(58) Field of Classification Search ..... 439/49, 439/189, 35, 221, 956; 310/71; 174/152 R
See application file for complete search history.

(56) References Cited

U.S. PATENT DOCUMENTS

| | | | | |
|---|---|---|---|---|
| 1,393,822 | A * | 10/1921 | Parker | 439/189 |
| 2,459,615 | A | 1/1949 | Buchanan | |
| 2,922,054 | A * | 1/1960 | Miller | 310/71 |
| 3,453,403 | A * | 7/1969 | Hoffman | 200/51 R |
| 3,602,748 | A | 8/1971 | Locke | |
| 3,983,407 | A | 9/1976 | Shott | |
| 4,232,260 | A * | 11/1980 | Lambkin | 320/110 |
| 4,386,333 | A | 5/1983 | Dillan | |
| 4,405,190 | A * | 9/1983 | Schroeder | 439/503 |
| 4,429,935 | A | 2/1984 | Lamb et al. | |
| 4,748,355 | A | 5/1988 | Anderson et al. | |
| 4,781,610 | A | 11/1988 | Mercer | |
| 4,880,391 | A | 11/1989 | Hurtgen | |
| 5,007,156 | A | 4/1991 | Hurtgen | |
| 5,017,818 | A | 5/1991 | Dohgne | |
| 6,040,646 | A | 3/2000 | Peters | |
| 6,048,219 | A | 4/2000 | Kotowski | |
| 6,106,324 | A | 8/2000 | Kwapien et al. | |
| 6,879,070 | B2 | 4/2005 | Leany et al. | |

FOREIGN PATENT DOCUMENTS

BR PL8706292 6/1989

* cited by examiner

*Primary Examiner* — T C Patel
*Assistant Examiner* — Travis Chambers
(74) *Attorney, Agent, or Firm* — Standley Law Group LLP

(57) ABSTRACT

A device for interfacing power from an electrical supply having power terminals, that permits implementation of a wide range of power cord lengths and voltage connection combinations. The device includes a body having a cord side and an appliance side. The body has four or more terminals located on the cord side of the body, with one terminal being a ground terminal. At least one electrical connecting device is adapted to connect terminals. In a first configuration, the device is used at a lower voltage. In a second configuration, the device is used at a higher voltage.

22 Claims, 11 Drawing Sheets

MULTI-VOLTAGE PUMP WITH DISCREET VOLTAGE CORDS

CROSS-REFERENCE TO RELATED APPLICATIONS

This application claims priority of U.S. Provisional Patent Application No. 61/106,350, filed Oct. 17, 2008, which is incorporated by reference as if fully recited herein.

TECHNICAL FIELD

The present invention is directed to a device for interfacing power. More particularly, the present invention is directed to a device for interfacing power from an electrical supply having lead wires to an electrical appliance, and permits implementation of a wide range of power cord lengths and voltage connection combinations.

BACKGROUND OF THE ART

Many motor-operated appliances, in particular centrifugal pumps, have the capability to operate when supplied by any of several different power supplies when the appropriate electrical connection modifications are made. It is well known in the industry how to produce motors that drive pumps that are of dual-voltage design. Conversion from one voltage to the other only requires reconnection of the motor leads. This reconnection of the leads occurs in the factory at the time the power cord is attached to the pump or may be determined in the field. Additionally, at these times, the length of the power cord is another option that may be determined.

To accommodate the possible wide range of voltage connection and cord length combinations demanded in customer applications, many different pump and power cord configurations are required to be kept in inventory. This consequently and undesirably increases cost and complicates distribution requirements. What is needed is a means to delay the determination of cord length and selection of voltage rating connections until a pump system is ready to be installed in the field and precise requirements are known by the customer as well as an easy means to implement such desired configurations.

As a matter of convenience, this specification will refer to "115 volt" single phase power and "230 volt" single-phase power. In reality, and as will be readily understood, the actual voltages may vary. Furthermore, different countries may provide standard electrical power at different voltages and frequencies than 115 volts or 230 volts. For that reason, the term "115 volt" refers to a first or lower nominal alternating current voltage level that is commercially available and the term "230 volt" refers to a second or higher nominal alternating current voltage level. In many countries, for example, the United States of America, the second or higher nominal voltage level is approximately double that of the first. Furthermore, although certain portions of the specification may refer to single phase power, it should be understood that the application may be used with three phase power as well.

SUMMARY

The present invention is directed to a device for interfacing power from an electrical supply having lead wires and a ground wire that permits implementation of a wide range of power cord lengths and voltage connection combinations. Certain embodiments of the device include a body having a cord side and an appliance side. The body has four or more terminals located on the cord side of the body. In some embodiments, one terminal may be a ground terminal. At least one electrical connecting device is adapted to connect terminals. In a first configuration, the device is used at a lower voltage. In a second configuration, the device is used at a higher voltage. In certain exemplary embodiments, at least one of the terminals may be adapted to connect a sensing device.

In contrast to known means of effecting power rating connections on, for example, motor systems by which a power connection cover is removed from the motor housing and wiring connections made accordingly, an exemplary embodiment permits the power rating connection to be made within the power cord itself. One principal advantage of this approach is that cord length selection can easily and quickly be made to meet customer requirements. By retaining a less diverse inventory, some exemplary embodiments may reduce the inventory cost throughout the distribution channel. In some exemplary embodiments, the manufacturing costs may be reduced by eliminating the need to add a cord.

Some exemplary embodiments may allow standardization of manufacturing practices that may reduce the potential for misconnections, which can result in rework costs and the potential to permanently damage system components. In certain embodiments, the cord may allow a distributor/end-user the ability to easily alter the voltage connection without having to gain access to the internals of a pump. In the case of some pumps, exemplary embodiments may eliminate the need to open the pump in the field and opening any factory sealed watertight joints.

One object of exemplary embodiments is to delay the determination of cord length and voltage rating connection until the unit is ready to be installed in the field and customer requirements are known.

Another object of exemplary embodiments is to reduce the number of units required to be inventoried and to realize consequent cost savings.

While certain embodiments of the present invention are described in detail herein, the scope of the invention is not to be considered limited by such disclosure, and modifications are possible without departing from the spirit of the invention.

BRIEF DESCRIPTION OF THE DRAWINGS

Other aspects of the present invention will be readily apparent from the following descriptions of the drawings and exemplary embodiments, wherein identical reference numerals refer to identical parts, and wherein.

DETAILED DESCRIPTION

Some sample embodiments of the present invention will now be described in greater detail. Nevertheless, it should be recognized that the present invention may be practiced in a wide range of other embodiments besides those explicitly described, and the scope of the present invention is expressly not limited except as specified in any accompanying claims.

Figure 1:
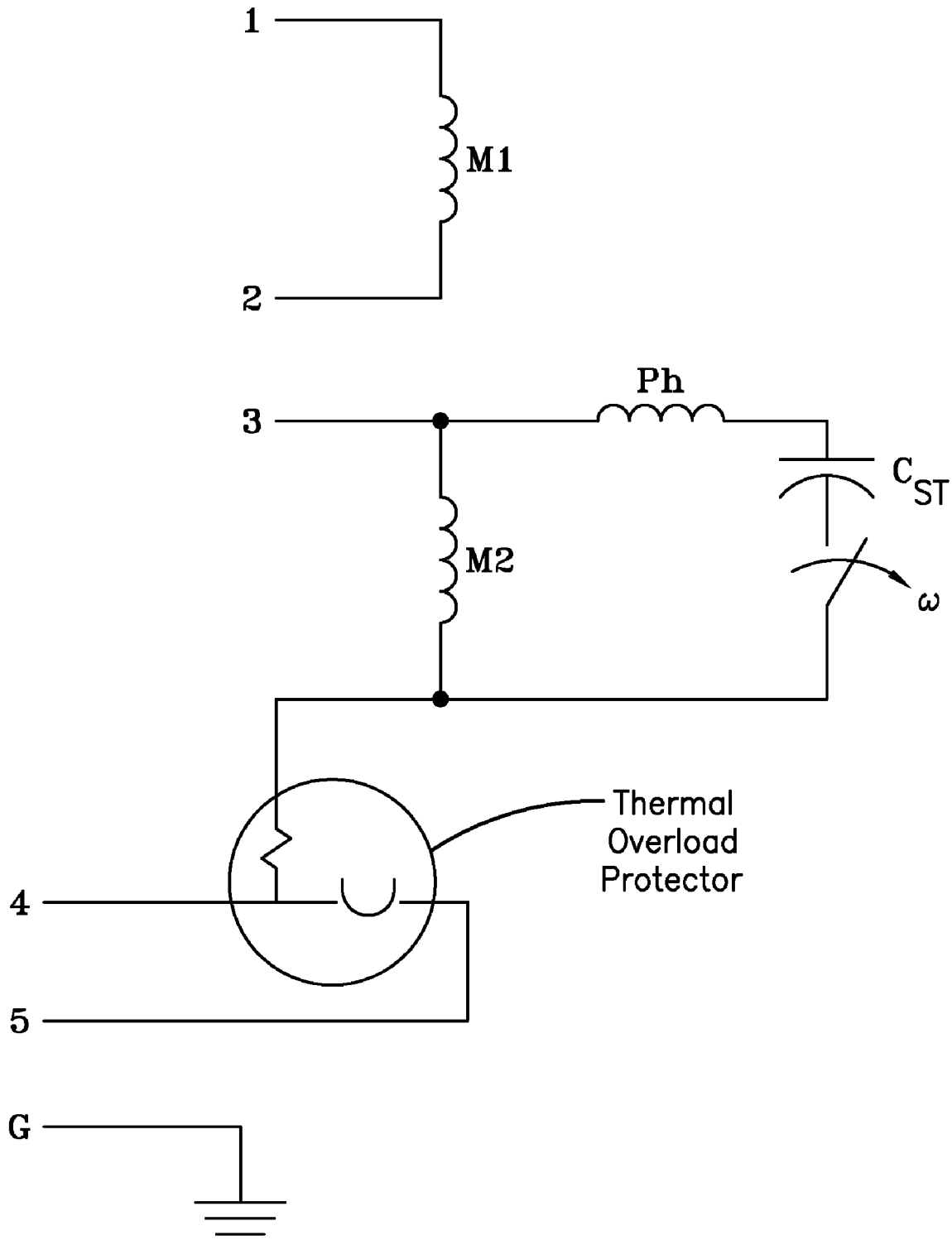
FIG. 1 depicts a schematic electric circuit diagram illustrating a single-phase motor wiring scheme.

FIG. 1 illustrates how a motor typically used on, for example, a pump may be internally electrically wired and is typical for a dual-voltage capacitor start motor. Lead wires 1 and 2 are connected to opposite ends of the first part of the main winding M1. Lead wire 3 is connected to the other portion of the main winding M2 as well as the phase Ph or auxiliary winding and the start capacitor $C_{st}$ and motor start switch ω. Lead wires 4 and 5 are connected to the thermal protector in the motor which is appropriately connected for a dual-voltage motor. It should be noted that exemplary embodiments may work equally well for other single-phase dual-voltage motor types and connections. For example, in some exemplary embodiments, the electrical appliance may not include the aforementioned ground wire and/or thermal protector.

Figure 2:
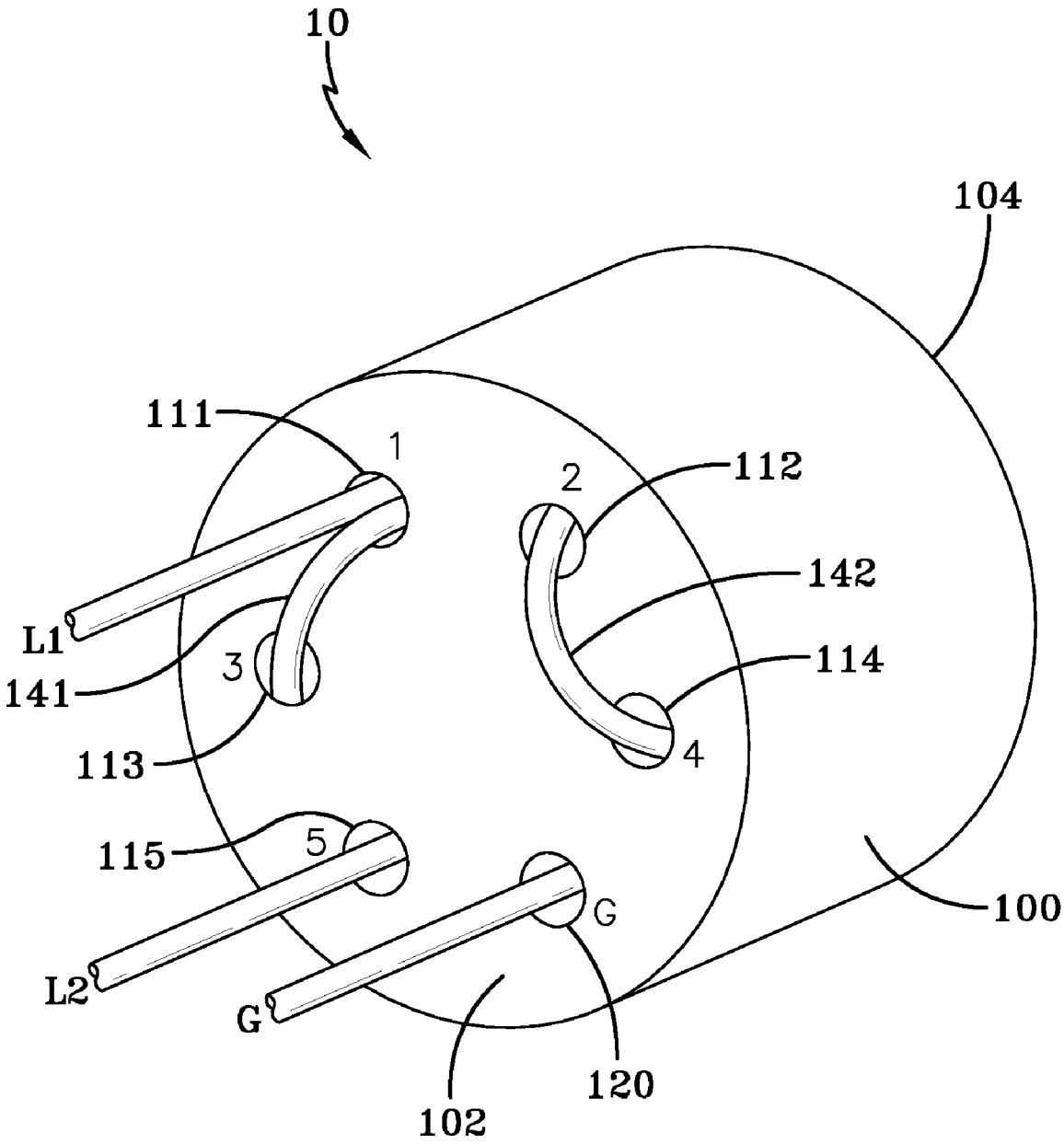
FIG. 2 is a perspective view illustrating one exemplary embodiment of the device for interfacing power from an electrical supply configured for a lower voltage single-phase power supply.

FIG. 2 illustrates one way a power cord may be connected using an exemplary embodiment of the device 10 so that an appliance, such as a pump motor, may be operated from a lower voltage power supply, for example, a 115 Volt power supply. As shown, this exemplary embodiment includes a device 10 for interfacing power (hereinafter "device") from an electrical supply, having lead wires and a ground wire, to the electrical appliance. Typically, the device 10 includes a body 100 having a cord side 102 and an appliance side 104. The body 100 includes six terminals 111, 112, 113, 114, 115, 120 located on the cord side 102, wherein one terminal is a ground terminal 120. Additionally, this particular device 10 includes two electrical connecting devices 141, 142 adapted to connect terminals. Preferably, the device 10 in a first configuration allows for usage at a lower voltage and in a second configuration allows for usage at a higher voltage.

In this embodiment, the body 100 is substantially cylindrical in shape to facilitate securement with or within an electrical cord during use thereof. However, it should be realized that the body 100 may have any number of cross-sectional geometries that permit securement with or within an electrical cord during use of the device 10. Preferably, the cross-sectional geometry allows for the device 10 to be installed with minimal difficulty. It is also preferred that the geometry allows for an individual to connect or disconnect the electrical connecting device with minimal difficulty. In some embodiments, numbers, letters and/or symbols may be integrated into the body 100 to improve identifying the terminals and other components of the device 10.

The body 100 may be made of any number of materials, such as, for example, plastics, fiberglass, ceramics and rubber. Preferably the body 100 has sufficient strength to permit proper operation of the device 10. Additionally, it is preferred that the material used to fabricate the body 100 has sufficient electrical insulation properties to allow proper operation of the device 10.

Located on the cord side 102 of the body 100, the device 10 has four or more terminals 111, 112, 113, 114, 115 wherein one terminal is a ground terminal 120. Although the exemplary embodiments described include a ground terminal 120, certain other exemplary embodiments may not include a ground terminal. However, it is preferred that a ground terminal is used for increased safety while operating the electrical appliance. The terminals may be any number of different electrical terminals, including, but not limited to: splices, solder lugs, tongue crimps terminals, turrets, test probes, clips, screw terminals, tab terminals, tip terminals, etc. Typically, but not necessarily, the terminals are molded within the body 100 during fabrication. In this particular embodiment, the terminals are open barrel socket terminals. Although the terminals in this embodiment are female receptacles, other embodiments may use any number of other suitable terminals. Preferably, but not necessarily, the terminals allow for quick connection of the lead wires and electrical connecting devices with the device 10. Although the exemplary embodiment seen in FIG. 2 uses six terminals 111, 112, 113, 114, 115, 120, other exemplary embodiments may use any number of additional terminals, as needed to achieve desired voltages. In certain exemplary embodiments, the terminals may be sensor terminals 130. Sensor terminals 130 are terminals adapted to secure sensor devices. In some embodiments, the sensor terminals 130 may be adapted to secure sensor wires. Any number of various sensor wires may be adapted to the sensor terminals 130 to sense varying conditions within or around the electrical appliances, including, but not limited to: thermal, electromagnetic, mechanical, chemical, optical and acoustic.

In whatever form, at least one electrical connecting device (ie. 141, 142, 241, etc.) is adapted to connect terminals. For example, FIGS. 2, 3, 5, 6, 9 and 10 show jumper wires used as the electrical connecting devices. In these particular embodiments, the jumper wires are molded into the body 100. The jumper wires are shown outside the body 100 for viewing convenience. However, other exemplary embodiments may include jumper wires that are located outside the body 100. Furthermore, other exemplary embodiments may use different electrical connecting devices, including, but not limited to: crimp-on terminals, insulation displacement connectors, plug and socket connectors, and component and device connectors. Preferably, but not necessarily, the electrical connecting device (ie. 141, 142, 241, etc.) allows for quick connection and disconnection between the terminals 111, 112, 113, 114, 115. It is also preferred that one standard electrical connecting device may connect all the desired combinations of terminals, to save inventory cost.

As shown in FIG. 2, an exemplary embodiment of the device 10 may be configured for a lower voltage single phase power supply from an electrical supply. In this embodiment, the cord leading to the device 10 may have, for example, a standard 115 Volt three-prong electrical supply integrally attached. In this particular embodiment, the ground terminal 120 may be adapted to secure the ground wire and may be subsequently connected, for example, to a dead metal portion of the appliance. The first terminal 111 is adapted to secure first lead wire L1. Also, the first electrical connecting device 141 connects the first and third terminals 111, 113 of the body 100 via an internal jumper wire that is molded into the body 100, which subsequently may be connected to the neutral wire at the 115 Volt electrical supply at the opposite end of the cord. Additionally, the fifth terminal 115 is adapted to secure the "hot" wire of the 115 Volt electrical supply L2. Finally, a second electrical connecting device 142 may be molded into the appliance end of the cord connecting second and fourth terminals 112, 114, thus completing the electrical connection for a appliance intended to be attached or connected into a properly wired 115 Volt electrical source.

Figure 3:
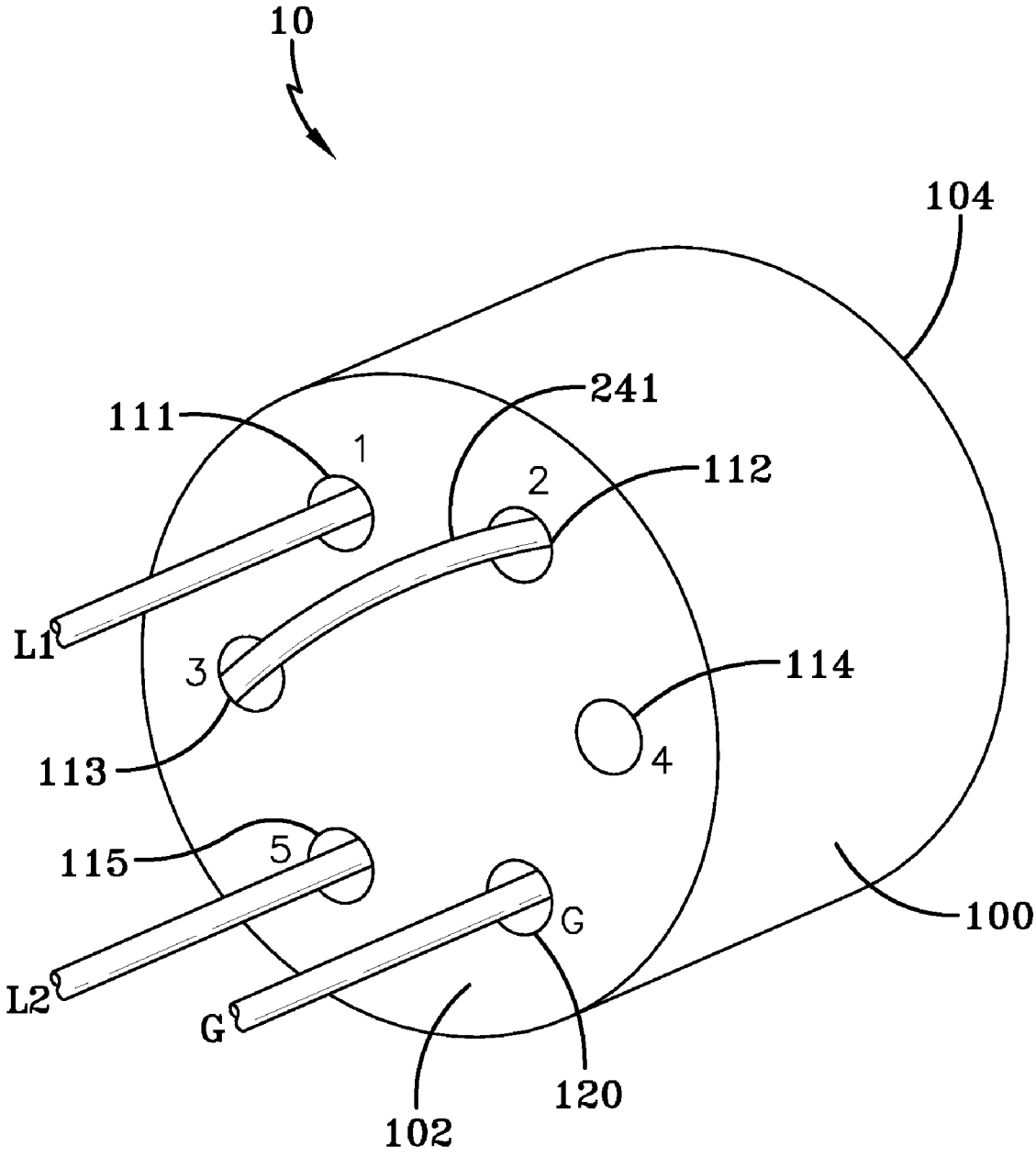
FIG. 3 is a perspective view illustrating one exemplary embodiment of the device for interfacing power from an electrical supply configured for a higher voltage single-phase power supply.

FIG. 3 illustrates one possible configuration of the connections of the device 10 for a higher-voltage, 230 Volt single-phase application. In this particular embodiment, a different electrical power cord may be employed for this connection. On one end of the power cord may be a standard 230 Volt electrical supply. In this embodiment, the first and fifth terminals 111, 115 are adapted to secure two "hot" wires L1 and L2 while the grounded terminal 120 is adapted to secure the ground wire G, as shown. Furthermore, the first electrical connecting device 241 connects the second and third terminals 112, 113. In this particular embodiment, the first electrical connecting device 241 may be internal to the cord.

Figure 4:
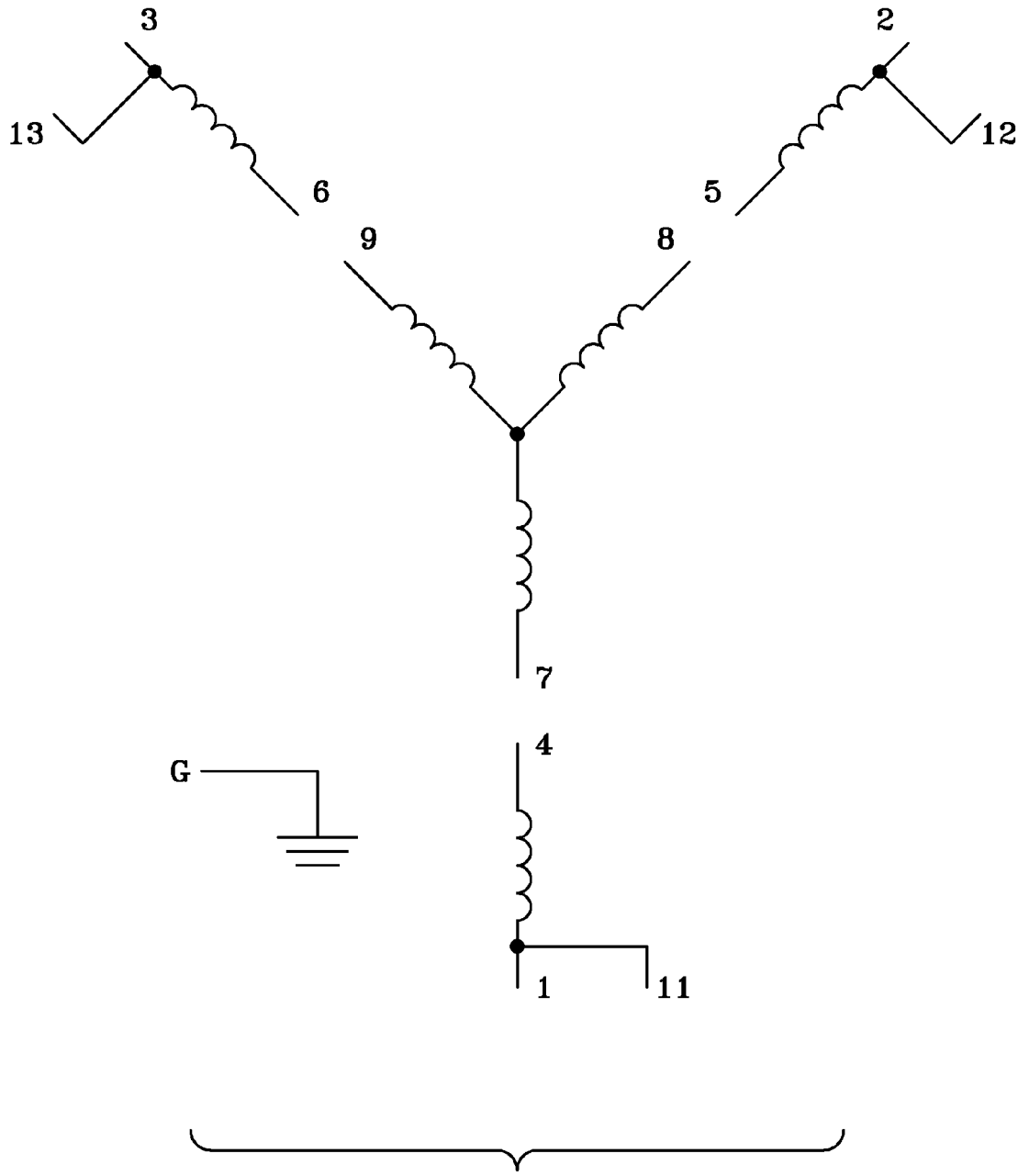
FIG. 4 depicts a schematic electric circuit diagram illustrating a three-phase motor wiring scheme.

FIG. 4 illustrates a schematic for a three-phase Y-connected motor for an electrical appliance, for example, a pump. It should be noted that exemplary embodiments may work equally well for other three-phase dual-voltage motor types and connections.

Figure 5:
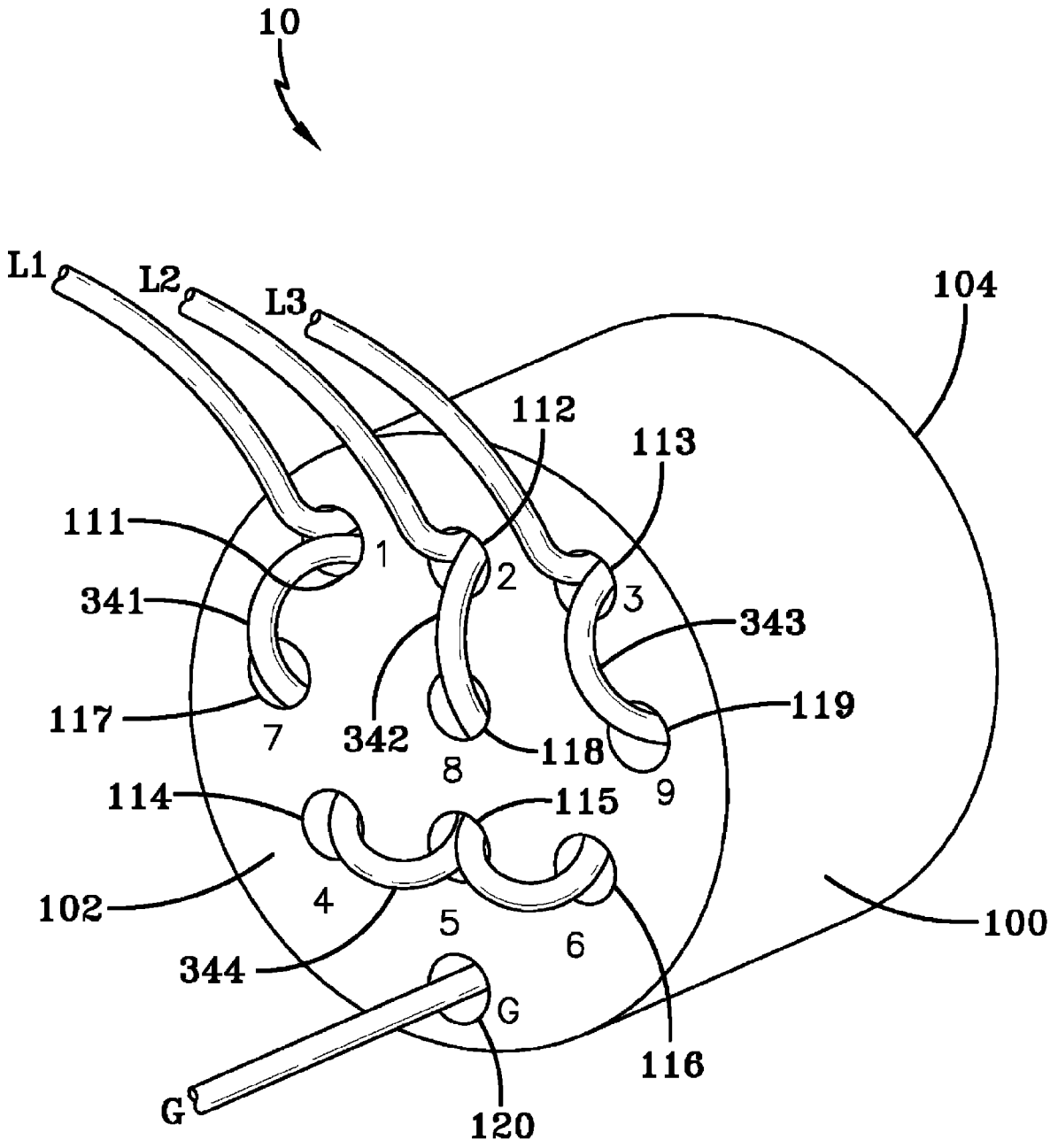
FIG. 5 is a perspective view illustrating one exemplary embodiment of the device for interfacing power from an electrical supply configured for a lower voltage three-phase power supply.

FIG. 5 illustrates how one exemplary embodiment of the device 10 may be configured for a lower voltage three-phase power supply. In this particular embodiment, the ground terminal 120 may be adapted to secure the ground wire. The first terminal 111 is adapted to secure the first lead wire L1 and a portion of the first electrical connecting device 341. Likewise, the second terminal 112 is adapted to secure the second lead wire L2 and a portion of the second electrical connecting device 342, and the third terminal 113 is adapted to secure the third lead wire L3 and a portion of third electrical connecting device 343. In this particular embodiment, all the lead wires may be "hot" wires. The first electrical connecting device 341 connects the first and seventh terminals 111, 117 via an internal jumper wire that is molded into the body 100. Also, the second electrical connecting device 342 may be molded into the appliance side 104 of the body 100, connecting the second and eighth terminals 112, 118. The third electrical connecting device 343 connects the third and ninth terminals 113, 119. Furthermore, the fourth electrical connecting device 344 connects the fourth, fifth and sixth terminals 114, 115, and 116, thus completing the electrical connection for an appliance intended to be attached or connected into a properly wired lower voltage three-phase electrical supply.

Figure 6:
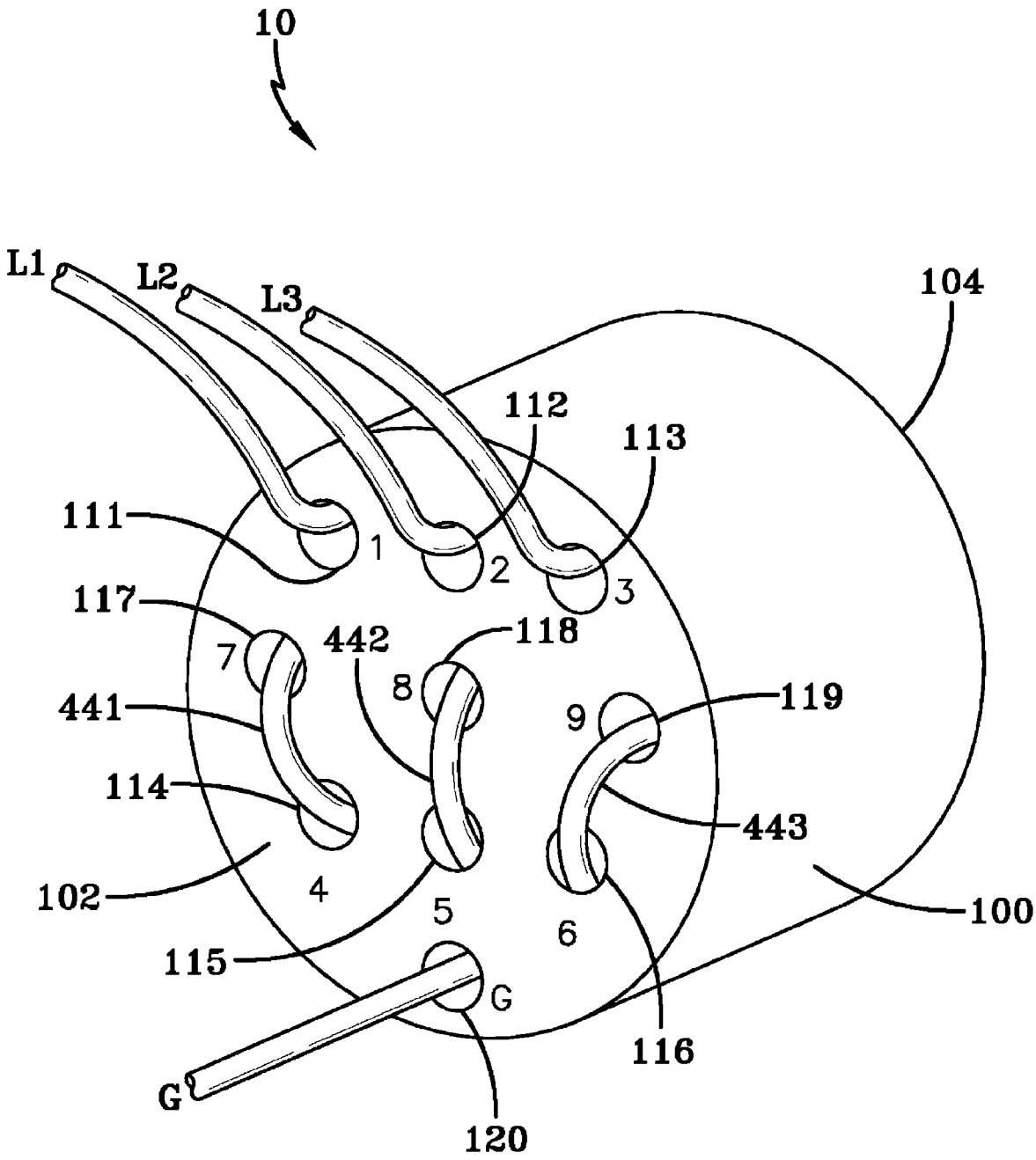
FIG. 6 is a perspective view illustrating one exemplary embodiment of the device for interfacing power from an electrical supply configured for a higher voltage three-phase power supply.

In another exemplary embodiment, the device 10 is configured for a higher voltage three-phase power supply, as depicted in FIG. 6. In this particular embodiment, the three lead wires L1, L2, L3 and ground wire G may be secured to the first, second third, and ground terminals 111, 112, 113, 120 as in the aforementioned exemplary embodiment seen in FIG. 5. In this particular embodiment, all the lead wires may be "hot" wires. Preferably, but not necessarily, each terminal is adapted to secure a portion of the electrical connecting devices used. In this particular embodiment, the first electrical connecting device 441 connects the seventh and fourth terminals 117, 114 via an internal jumper wire that is molded into the body 100. Also, the second electrical connecting device 442 may be molded into the appliance side 104 of the body 100, connecting the eighth and fifth terminals 118, 115. The third electrical connecting device 443 connects the ninth and sixth terminals 119, 116, thus completing the electrical connection for an appliance intended to be attached or connected into a properly wired higher voltage three-phase electrical supply.

Figure 7:
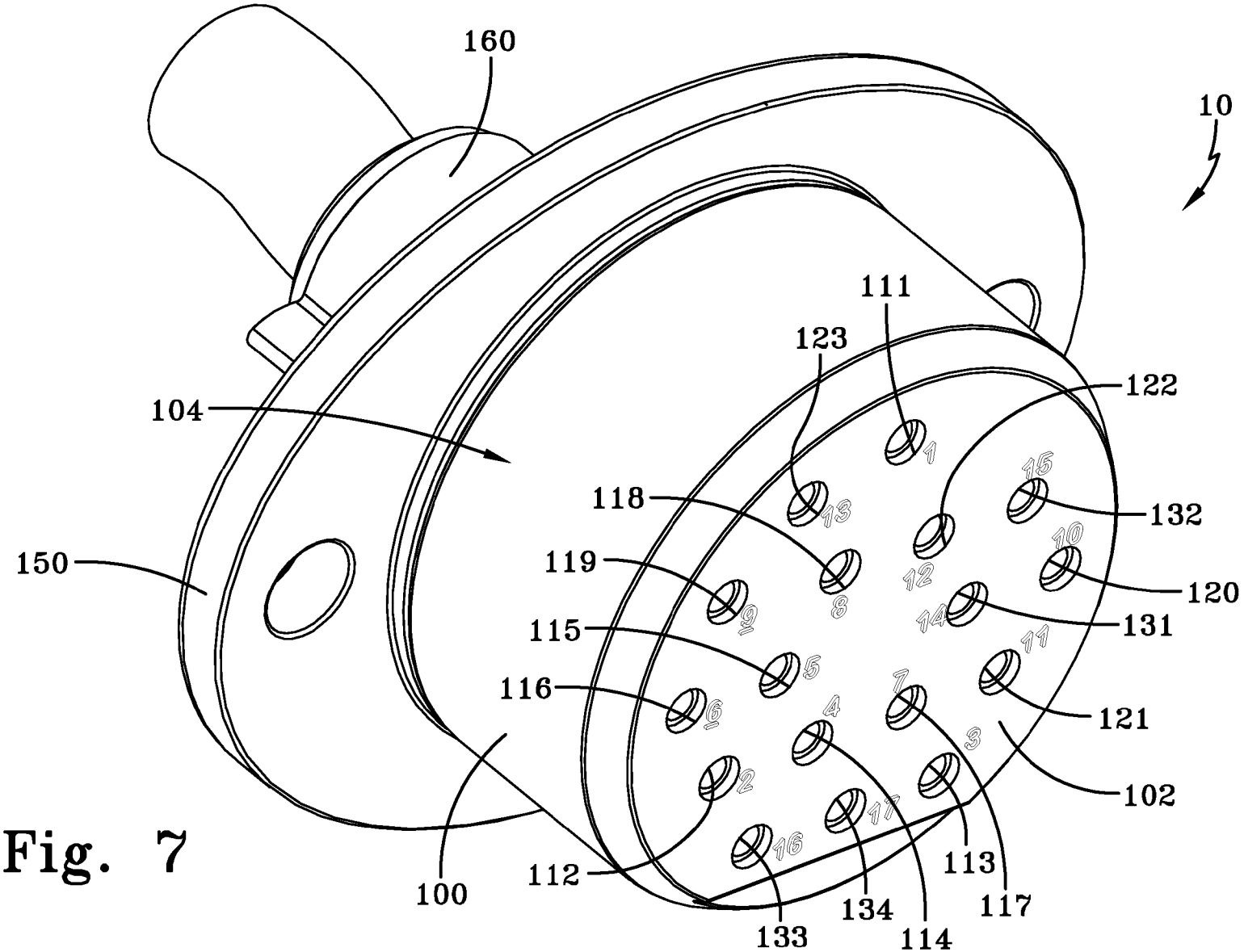
FIG. 7 is a perspective view illustrating one exemplary embodiment of the device for interfacing power from an electrical supply.
Figure 8:
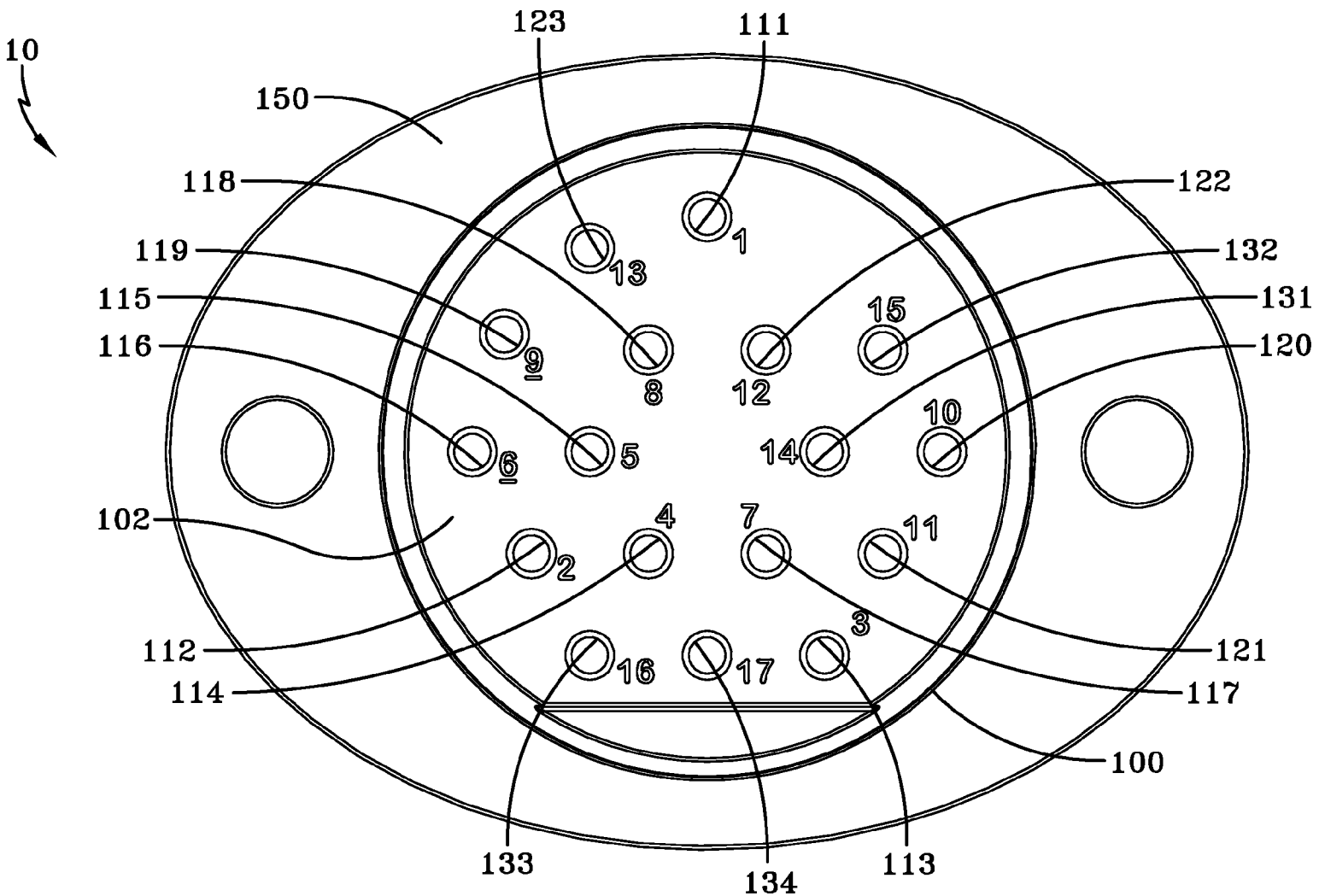
FIG. 8 is a front elevation view of an exemplary embodiment of the device for interfacing power from an electrical supply.
Figure 9:
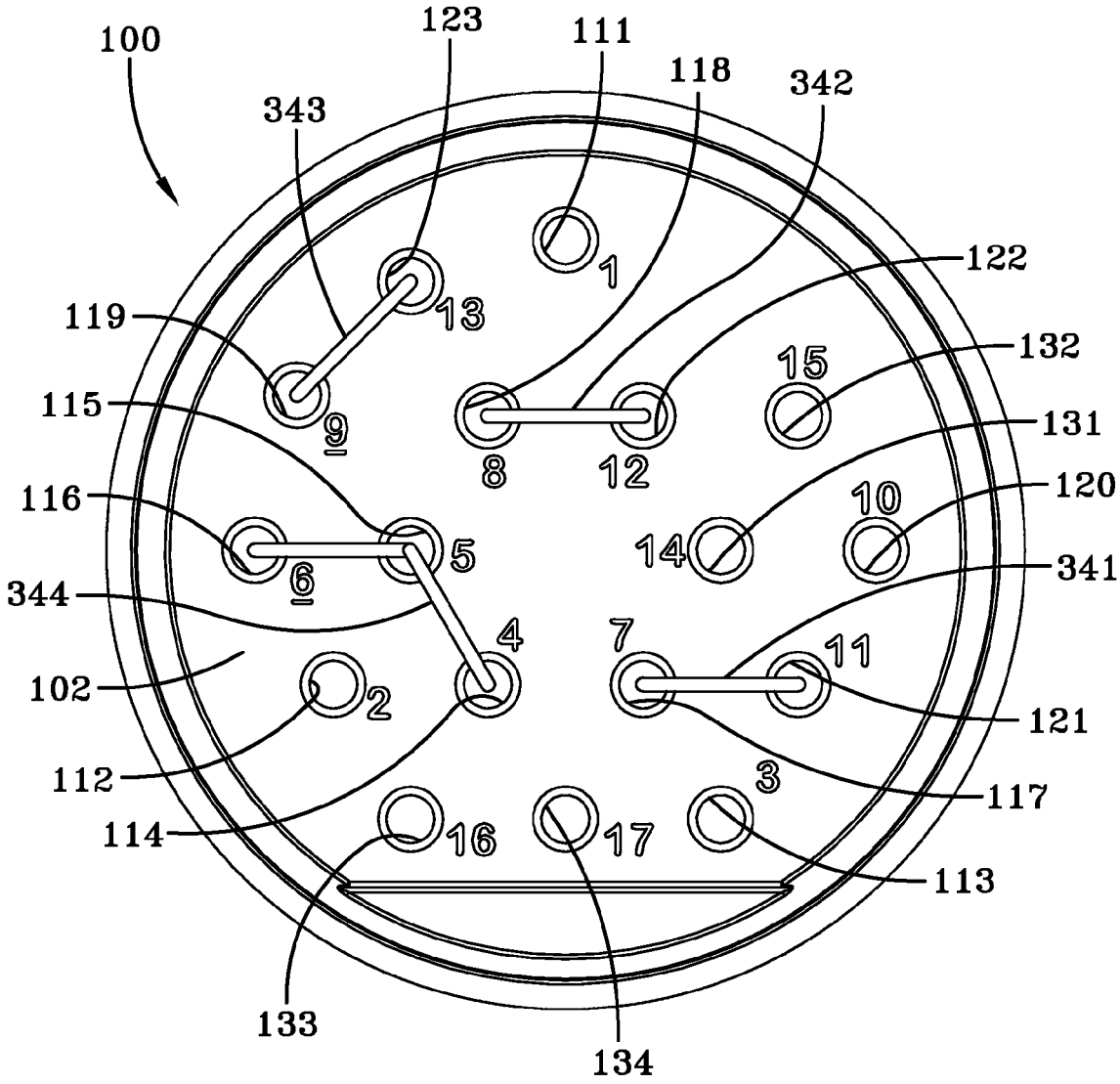
FIG. 9 is a front elevation view illustrating one exemplary embodiment of the body of the device for interfacing power from an electrical supply configured for a higher voltage three-phase supply.
Figure 11:
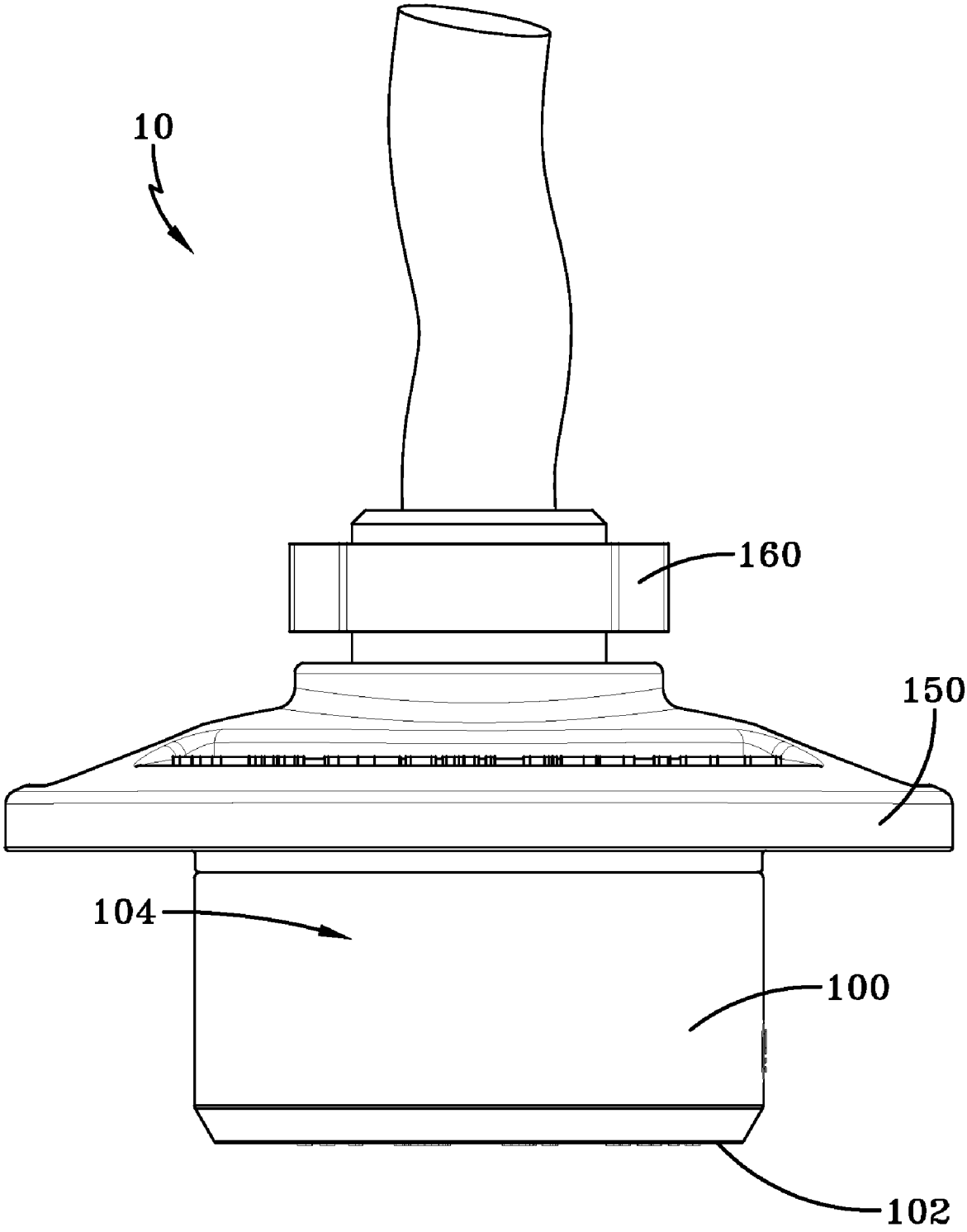
FIG. 11 illustrates a top plan view of one exemplary embodiment of the device for interfacing power from an electrical supply.

FIGS. 7, 8 and 11 illustrate another exemplary embodiment of how the terminals of the device may be situated. Moreover, FIG. 9 illustrates another exemplary embodiment of the device 10 configured for lower voltage three-phase power supply. In this particular embodiment, all the lead wires may be "hot" wires. Furthermore, the first and eleventh terminals 111, 121 are adapted to secure the first lead wire L1, thereby interconnecting the first and eleventh terminals 111, 121 into the motor winding. In a similar fashion, the second and twelfth terminals 112, 122 are adapted to secure the second lead wire L2, thereby interconnecting the second and twelfth terminals 112, 122 into the motor winding. Likewise, the third and thirteenth terminals 113, 123 are adapted to secure the third lead wire L3, thereby interconnecting the third and thirteenth terminals 113, 123 into the motor winding.

Preferably, but not necessarily, each terminal is adapted to secure a portion of the electrical connecting devices used. In this particular embodiment, the first electrical connecting device 341 connects the seventh and eleventh terminals 117, 121 via an internal jumper wire that is molded into the body 100. Also, the second electrical connecting device 342 may be molded into the appliance side 104 of the body 100, connecting the eighth and twelfth terminals 118, 122. The third electrical connecting device 343 connects the ninth and thirteenth terminals 119, 123. Additionally, the fourth electrical connecting device 344 connects the fourth, fifth and sixth terminals 114, 115, 116 thus completing the electrical connection for an appliance intended to be attached or connected into a properly wired lower voltage three-phase electrical supply. The body 100 includes four sensor terminals 131, 132, 133, 134 that are adapted to secure sensor wires. In this particular embodiment, the first and second sensor terminals 131, 132 secure sensor wires used to sense temperature; and the third and fourth sensor terminals 133, 134 are used to sense moisture.

In certain embodiments, a compression device may be used to compress at least a portion of the body 100 during insertion of the body 100 within an electrical appliance. The compression device may facilitate a watertight seal between the body 100 and the receiving portion of the electrical appliance. This may allow the electrical device to operate in harsh environments that may contain high humidity and other unwanted characteristics. In this particular embodiment, the device may include a flange 150 and a clamp 160. The flange 150 may be adapted to engage at least a portion of the exterior of the body 100. In this particular embodiment, the flange 150 engages the periphery of the appliance side 104. However, in other embodiments, the flange 150 may be adapted to engage any portion of the body 100. In certain embodiments, the flange 150 may be integral with at least a portion of the body 100.

In this embodiment, the flange 150 is substantially cylindrical in shape to facilitate securement with the body 100. However, it should be realized that the flange 150 may have any number of cross-sectional geometries that permit securement with the body 100 during use of the device 10. Preferably, the cross-sectional geometry allows for the device 10 to be installed with minimal difficulty. It is also preferred that the geometry allows for an individual to connect or disconnect the electrical connecting device with minimal difficulty.

The flange 150 may be made of any number of materials, such as, for example: plastics, fiberglass, ceramics, metals, and rubber. In this particular embodiment, the flange 150 is fabricated from stainless steel. Preferably the flange 150 has sufficient strength to permit proper operation of the device 10. Additionally, it is preferred that the material used to fabricate the flange 150 has corrosion resistance to allow proper operation of the device 10.

In this exemplary embodiment the clamp 160 may be adapted to engage at least a portion of the exterior of the body 100. In this particular embodiment, the clamp 160 engages the periphery of the appliance side 104. However, in other embodiments, the clamp 160 may be adapted to engage any portion of the body 100. In certain embodiments, at least a portion of the clamp 160 may be integral with at least a portion of the body 100.

In this embodiment, the clamp 160 is substantially cylindrical in shape to facilitate securement with the body 100. However, it should be realized that the clamp 160 may have any number of cross-sectional geometries that permit securement with the body 100 during use of the device 10. Preferably, the cross-sectional geometry allows for the device 10 to be installed with minimal difficulty. It is also preferred that the geometry allows for an individual to connect or disconnect the electrical connecting device with minimal difficulty.

The clamp 160 may be made of any number of materials, such as, for example: plastics, fiberglass, ceramics, metals and rubber. In this particular embodiment, the clamp 160 is fabricated from stainless steel. Preferably the clamp 160 has sufficient strength to permit proper operation of the device 10. Additionally, it is preferred that the material used to fabricate the clamp 160 has corrosion resistance insulation properties to allow proper operation of the device 10.

Figure 10:
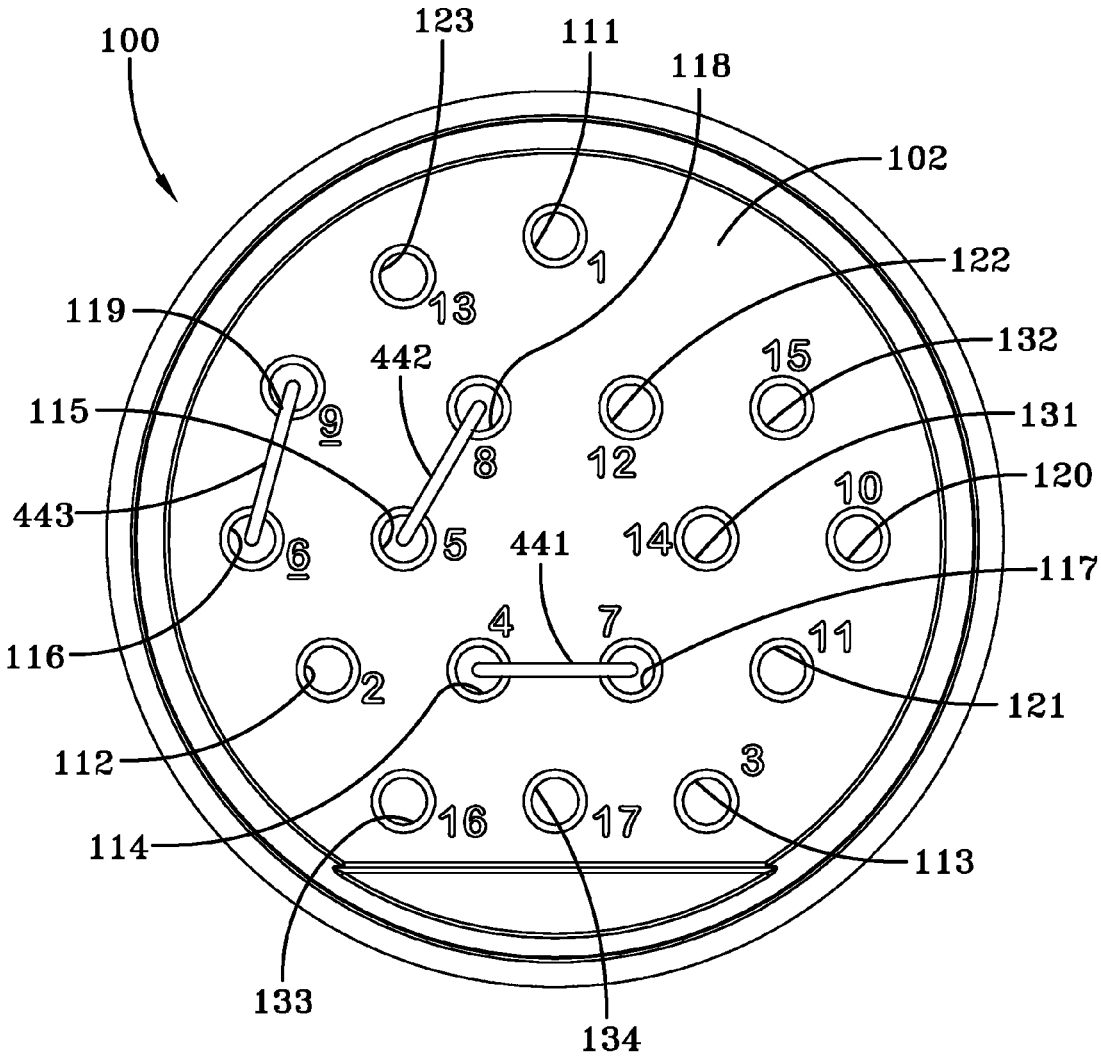
FIG. 10 is a front elevation view illustrating one exemplary embodiment of the body of the device for interfacing power from an electrical supply configured for a lower voltage three-phase supply.

FIG. 10 illustrates another exemplary embodiment of the device 10, configured for higher voltage three-phase power supply. In this particular embodiment, all the lead wires may be "hot" wires. Furthermore, the first and eleventh terminals 111, 121 are adapted to secure the first lead wire L1, thereby interconnecting the first and eleventh terminals 111, 121 into the motor winding. In a similar fashion, the second and twelfth terminals 112, 122 are adapted to secure the second lead wire L2, thereby interconnecting the second and twelfth terminals 112, 122 into the motor winding. Likewise, the third and thirteenth terminals 113, 123 are adapted to secure the third lead wire L3, thereby interconnecting the third and thirteenth terminals 113, 123 into the motor winding.

Preferably, but not necessarily, each terminal is adapted to secure a portion of the electrical connecting devices used. In this particular embodiment, the first electrical connecting device 441 connects the fourth and seventh terminals 114, 117 via an internal jumper wire that is molded into the body 100. Also, the second electrical connecting device 442 may be molded into the body 100, connecting the fifth and eighth terminals 115, 118. The third electrical connecting device 443 connects the sixth and ninth terminals 116, 119 thus completing the electrical connection for an appliance intended to be attached or connected into a properly wired higher voltage three-phase electrical supply. The body 100 includes four sensor terminals 131, 132, 133, 134 that are adapted to secure sensor wires. In this particular embodiment, the first and second sensor terminals 131, 132 secure sensor wires used to sense temperature; and the third and fourth sensor terminals 133, 134 are used to sense moisture.

Additionally, in any exemplary embodiment of the device 10, it is possible for the device 10 to be used within a pump that may operate at multiple voltages. The device 10 may be secured with or within the power cord of the pump, as aforementioned.

What is claimed is:

1. A device for interfacing electrical power to an electrical appliance, the power being supplied through at least one lead wire and a ground wire, each lead and ground wire connected to a corresponding power terminal and the appliance having at least two appliance terminals for mating with the device, the device comprising:

a body having a cord side and an appliance side;

four or more cord terminals located on the cord side of the body, each cord terminal sized and adapted for receiving one of the power terminals; and at least one electrical connecting device, each electrical connecting device connecting a cord terminal to an appliance terminal or a cord terminal, so that, a first configuration allows for usage at a first voltage and a second configuration allows for usage at a second voltage, wherein the cord terminals are secured with the same appliance terminals in the first and second configurations.

2. The device of claim 1, wherein at least one cord terminal is a ground terminal.

3. The device of claim 1, wherein at least one cord terminal is adapted to secure the first of the power terminals, at least one cord terminal is adapted to secure the second of the power terminals.

4. The device of claim 1, further comprising at least one sensing device connected to a respective cord terminal.

5. The device of claim 4, wherein at least one cord terminal connects with a temperature sensing device and at least one cord terminal connects with a moisture sensing device.

6. The device of claim 1, wherein at least one cord terminal is adapted to secure the first of the power terminals, at least one cord terminal is adapted to secure the second of the power terminals, and at least one cord terminal is adapted to secure the third of the power terminals.

7. The device of claim 6, wherein two cord terminals are adapted to secure the first of the power terminals, two cord terminals are adapted to secure the second of the power terminals, and two cord terminals are adapted to secure the third of the power terminals.

8. The device of claim 1, wherein the first of the electrical connecting devices connects two cord terminals, the second of the electrical devices connects two cord terminals, the third of the electrical connecting devices connects two cord terminals, and the fourth of the electrical connecting devices connects three cord terminals.

9. The device of claim 8, wherein the first of the electrical connecting devices connects the seventh and eleventh cord terminals, the second of the electrical connecting devices connects the eighth and twelfth cord terminals, the third of the electrical connecting devices connects the ninth and thirteenth cord terminals, and the fourth of the electrical connecting devices connects the fourth, fifth and sixth cord terminals.

10. The device of claim 1, wherein the first of the electrical connecting devices connects two cord terminals, the second of the electrical devices connects two cord terminals, and the third of the electrical connecting devices connects two cord terminals.

11. The device of claim 10, wherein the first of the electrical connecting devices connects the fourth and seventh cord terminals, the second of the electrical connecting devices connects the fifth and eighth cord terminals, and the third of the electrical connecting devices connects the sixth and ninth cord terminals.

12. A device for interfacing electrical power to an electrical appliance, the power being supplied through at least one lead wire and a ground wire, each lead and ground wire connected to a corresponding power terminal and the appliance having at least two appliance terminals for mating with the device, the device comprising:

a body having a cord side and an appliance side;

four or more cord terminals located on the cord side of the body, each cord terminal sized and adapted for receiving one of the power terminals wherein one cord terminal is a ground terminal;

at least one sensing device connected to a respective cord terminal; and at least one electrical connecting device, each electrical connecting device connecting a cord terminal to an appliance terminal or a cord terminal, so that a first configuration allows for usage at a first voltage and a second configuration allows for usage at a second voltage, wherein the cord terminals are secured with the same appliance terminals in the first and second configurations.

13. The device of claim 12, wherein at least one cord terminal is adapted to secure the first of the power terminals, at least one cord terminal is adapted to secure the second of the power terminals.

14. The device of claim 12, wherein at least one cord terminal is adapted to secure the first of the power terminals, at least one cord terminal is adapted to secure the second of the power terminals, and at least one cord terminal is adapted to secure the third of the power terminals.

15. The device of claim 14, wherein two cord terminals are adapted to secure the first of the power terminals, two cord terminals are adapted to secure the second of the power terminals, and two cord terminals are adapted to secure the third of the power terminals.

16. The device of claim 12, wherein the first of the electrical connecting devices connects two cord terminals, the second of the electrical devices connects two cord terminals, the third of the electrical connecting devices connects two cord terminals, and the fourth of the electrical connecting devices connects three cord terminals.

17. The device of claim 16, wherein the first of the electrical connecting devices connects the seventh and eleventh cord terminals, the second of the electrical connecting devices connects the eighth and twelfth cord terminals, the third of the electrical connecting devices connects the ninth and thirteenth cord terminals, and the fourth of the electrical connecting devices connects the fourth, fifth and sixth cord terminals.

18. The device of claim 12, wherein the first of the electrical connecting devices connects two cord terminals, the second of the electrical devices connects two cord terminals, and the third of the electrical connecting devices connects two cord terminals.

19. The device of claim 18, wherein the first of the electrical connecting devices connects the fourth and seventh cord terminals, the second of the electrical connecting devices connects the fifth and eighth cord terminals, and the third of the electrical connecting devices connects the sixth and ninth cord terminals.

20. A device for interfacing electrical power to an electrical appliance, the power being supplied through at least one lead wire and a ground wire, each lead and ground wire connected to a corresponding power terminal and the appliance having at least two appliance terminals for mating with the device, the device comprising:

a body having a cord side and an appliance side;

four or more cord terminals located on the cord side of the body, each cord terminal sized and adapted for receiving one of the power terminals wherein one cord terminal is a ground terminal;

at least one sensing device connected to a respective cord terminal; and at least one electrical connecting device, each electrical connecting device connecting a cord terminal to an appliance terminal or a cord terminal, so that a first configuration allows for usage at a first voltage and a second configuration allows for usage at a second voltage, wherein two cord terminals are adapted to secure the first of the power terminals, two cord terminals are adapted to secure the second of the power terminals, and two cord terminals are adapted to secure the third of the power terminals, wherein the cord terminals are secured with the same appliance terminals in the first and second configurations.

21. The device of claim 20, wherein the first of the electrical connecting devices connects the seventh and eleventh cord terminals, the second of the electrical connecting devices connects the eighth and twelfth cord terminals, the third of the electrical connecting devices connects the ninth and thirteenth cord terminals, and the fourth of the electrical connecting devices connects the fourth, fifth and sixth cord terminals.

22. The device of claim 20, wherein the first of the electrical connecting devices connects the fourth and seventh cord terminals, the second of the electrical connecting devices connects the fifth and eighth cord terminals, and the third of the electrical connecting devices connects the sixth and ninth cord terminals.

* * * * *